United States Patent [19]

Ellison

[11] Patent Number: 4,930,686

[45] **Date of Patent: * Jun. 5, 1990**

[54] SELF-PRESSURIZING SPRAYER HAVING INLET PRESSURE RESPONSIVE VALVE

[75] Inventor: Garry L. Ellison, Grand Rapids, Mich.

[73] Assignee: Root-Lowell Manufacturing Company, Lowell, Mich.

[ * ] Notice: The portion of the term of this patent subsequent to Nov. 8, 2005 has been disclaimed.

[21] Appl. No.: 287,123

[22] Filed: Dec. 21, 1988

Related U.S. Application Data

[63] Continuation-in-part of Ser. No. 204,625, Jun. 9, 1988, which is a continuation-in-part of Ser. No. 58,519, Jun. 5, 1987, Pat. No. 4,782,982, which is a continuation-in-part of Ser. No. 3,469, Jan. 15, 1987, abandoned.

[51] Int. Cl.[5] ..... B65D 83/14; B05B 9/04

[52] U.S. Cl. ..... 222/394; 137/498; 137/512.3; 137/519; 141/2

[58] Field of Search ..... 222/1, 394–396, 222/400.5, 400.7, 400.8, 401, 478; 137/498, 512.3, 519; 141/2, 18, 347, 382

[56] References Cited

U.S. PATENT DOCUMENTS

| | | | |
|---|---|---|---|
| 1,616,775 | 2/1927 | Williams . | |
| 2,813,402 | 11/1957 | Poethig et al. | 62/1 |
| 2,917,077 | 12/1959 | Ziege | 137/514.7 |
| 2,968,315 | 1/1961 | Fisher | 137/517 |
| 3,103,950 | 9/1963 | Gulick | 137/494 |
| 3,211,173 | 10/1965 | Mueller et al. | 137/454.5 |
| 3,735,777 | 5/1973 | Katzer et al. | 137/514.5 |
| 3,749,141 | 7/1973 | Garretson | 137/512.3 |
| 3,782,640 | 1/1974 | Kirschmann | 239/571 |
| 3,794,077 | 2/1974 | Fanshier | 137/513.3 |
| 3,918,481 | 11/1975 | Doe et al. | 137/504 |
| 4,154,367 | 5/1979 | Hanson et al. | 222/130 |
| 4,180,189 | 12/1979 | Zurit et al. | 222/400.7 |
| 4,186,783 | 2/1980 | Brandt | 141/18 |
| 4,244,526 | 1/1981 | Arth | 239/533 |
| 4,319,604 | 3/1982 | Bird | 137/498 |
| 4,436,111 | 3/1984 | Gold et al. | 137/498 |
| 4,682,625 | 7/1987 | Christopher | 137/538 |
| 4,782,982 | 11/1988 | Ellison | 222/1 |

*Primary Examiner*—Michael S. Huppert
*Attorney, Agent, or Firm*—Price,Heneveld,Cooper, DeWitt & Litton

[57] ABSTRACT

A portable sprayer which has a resealable closure, a dispensing valve and a pressure-responsive filling valve attached to a receptacle. As the receptacle is filled with fluid through the valve, air which is entrapped in the receptacle pressurizes the container to facilitate dispensing the fluid. During filling, the inlet valve closes if the pressure of the liquid source to which the sprayer is connected exceeds that within the container by a predetermined amount. The inlet valve also closes when the filling hose is disconnected from the container in order to close the container.

23 Claims, 3 Drawing Sheets

SELF-PRESSURIZING SPRAYER HAVING INLET PRESSURE RESPONSIVE VALVE

CROSS REFERENCE TO RELATED APPLICATION

This is a continuation-in-part of patent application Ser. No. 07/204,625 filed June 9, 1988, which in turn was a continuation-in-part of patent application Ser. No. 07/058,519 filed June 5, 1987, now issued as U.S. Pat. No. 4,782,982 entitled SELFPRESSURIZING CHEMICAL SPRAYER, which in turn was a continuation-in-part of application Ser. No. 07/003,469 filed Jan 15, 1987, now abandoned.

BACKGROUND OF THE DISCLOSURE

This invention relates to sprayers, particularly small, portable sprayers which are often used around homes or in light industrial application. Such sprayers and liquid dispensers require manual pressurization before the liquid therein can be dispensed. After filling to a designated line with water, a chemical solution or other liquid to be dispensed, the sprayer is pressurized by a hand pump prior to dispensing. Such hand pump pressurized sprayers have been the industry standard for small, portable sprayers for many, many years.

Such sprayers typically include a removable closure, the hand pump typically being integral with the removable closure. One cleans chemicals out of the inside of such sprayers by removing the closure and rinsing the container a number of times with fresh water. The container is filled or partially filled with water, then turned over to dump the water and then refilled and reemptied several times.

SUMMARY OF THE INVENTION

The sprayer of the present invention is fitted not only with valved dispensing means as is common for such sprayers, but also with a filling valve adapted for connection to a pressurized source of the liquid to be dispensed from the sprayer whereby filling the sprayer with the liquid simultaneously serves to pressurize the sprayer. The filling valve is responsive to the pressure of the pressurized source of liquid in a manner that the valve will close if the source pressure is above a predetermined value, preventing the container from being over pressurized from a source of water under excessive pressure. The inlet valve will also close when the source of water is disconnected from the sprayer. The inlet valve thus functions as both a safety shutoff valve and as a one-way disconnect valve.

These and other objects, advantages and features of the present invention will be more fully understood and appreciated by reference to the written specification and appended drawings.

BRIEF DESCRIPTION OF THE DRAWINGS

Preferred embodiments of the invention have been depicted for illustrative purposes wherein.

DESCRIPTION OF THE PREFERRED EMBODIMENT

The preferred embodiment herein described is not intended to be exhaustive or to limit the invention to the precise form disclosed. It is chosen and described to illustrate the principles of the invention and its application and practical use to thereby enable others skilled in the art to utilize the invention.

Figure 1:
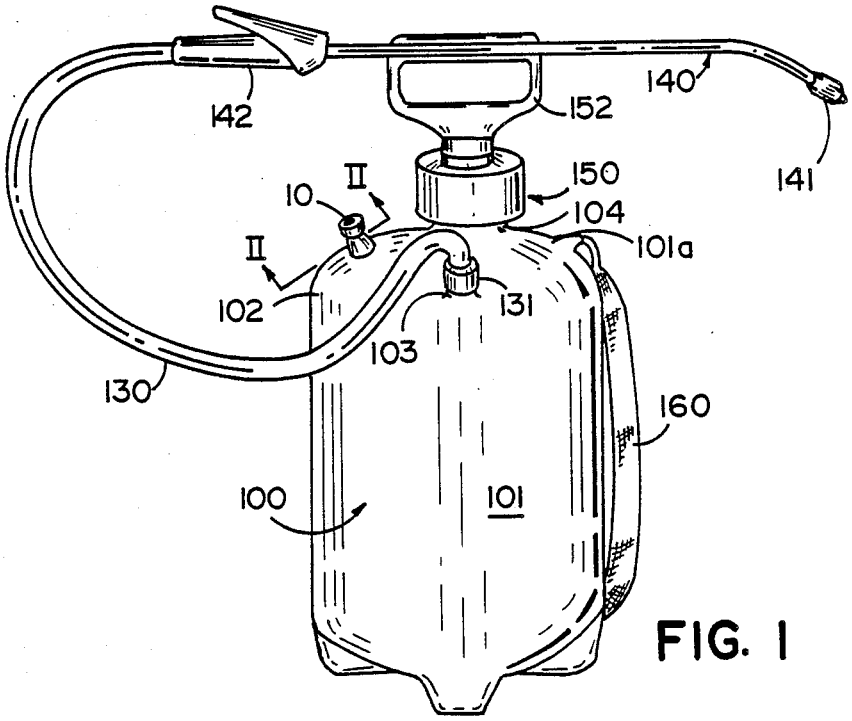
FIG. 1 is a perspective view of a sprayer made in accordance with the present invention.
Figure 3:
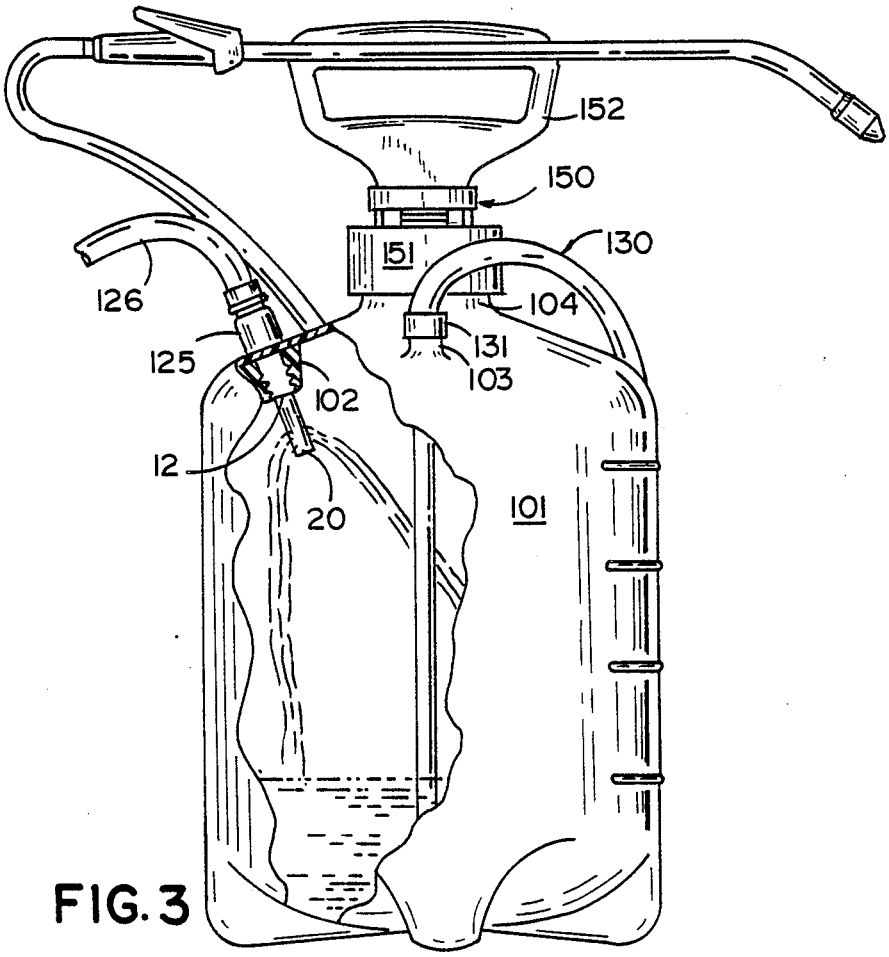
FIG. 3 is a partially broken view of the FIG. 1 sprayer being filled with liquid under pressure.
Figure 2A:
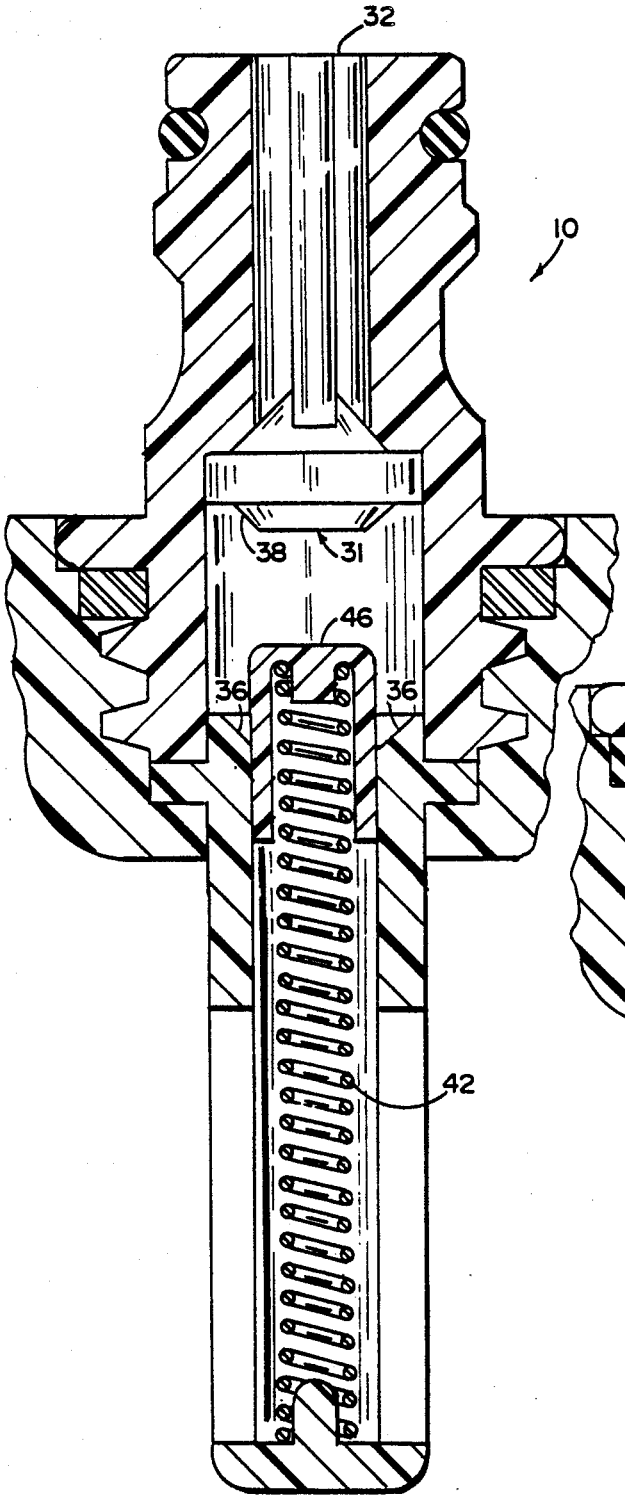
FIG. 2*a* is the same view as FIG. 2 with the inlet valve closed due to the source of pressurizing liquid being removed.
Figure 2B:
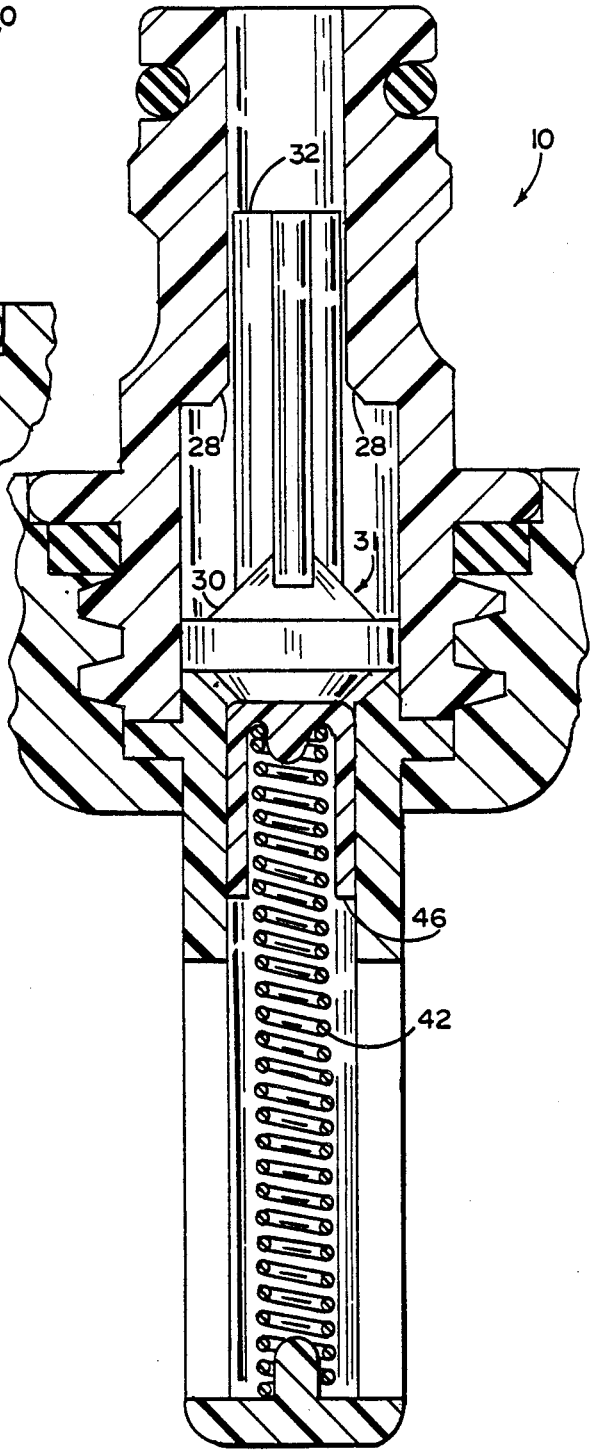
FIG. 2*b* is the same view as FIG. 2 with the inlet valve closed due to an excessive pressure of the liquid source.
Figure 2:
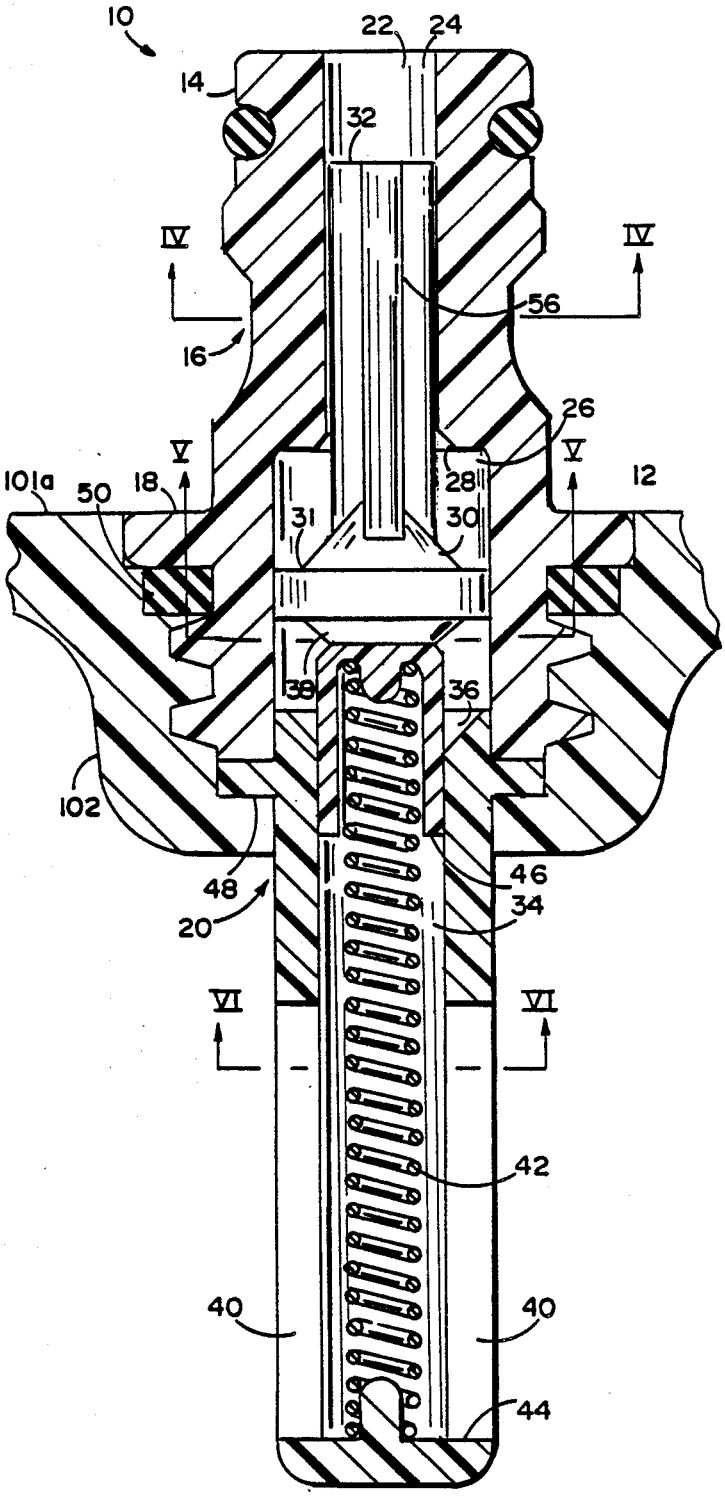
FIG. 2 is an enlarged fragmentary, cross-sectional view taken generally along plane II—II of FIG. 1 while the sprayer is being filled with liquid under pressure.
Figure 4:
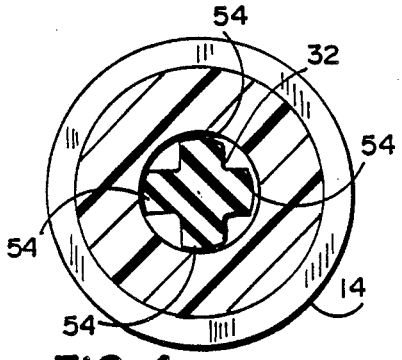
FIG. 4 is a cross-sectional view taken generally along plane IV—IV of FIG. 2.
Figure 5:
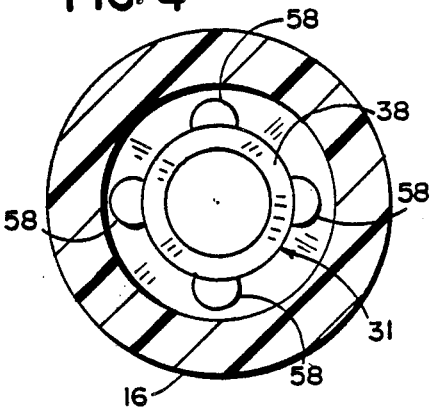
FIG. 5 is a cross-sectional view taken generally along plane V—V of FIG. 2.
Figure 6:
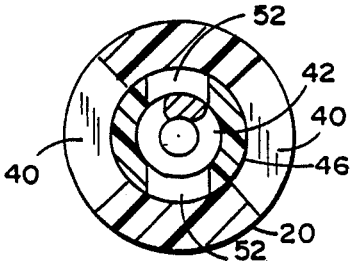
FIG. 6 is a cross-sectional view taken generally along the plane VI—VI of FIG. 2.

In the preferred embodiment, sprayer 100 (FIG. 1) comprises a molded plastic container 101, preferably molded of polyethylene, which includes an integrally molded, threaded recess 102 for receiving a filling valve assembly 10 including filling valve 12 and a quick-disconnect hose coupler 14 (FIGS. 1 and 2). Quick-disconnect hose coupler 14 is of a conventional quick-disconnect configuration. It is adapted for quick-disconnect mating to a quick-disconnect coupler 125 which can be threaded onto the end of a conventional garden hose or the like 126 (FIG. 3). Container 101 also includes an integrally molded outlet fitting 103 to which a delivery tube 130 is secured and an integrally molded threaded top opening 104 upon which the closure and hand pump assembly 150 is threadably mounted. Container 101 is filled by quick-connecting a garden hose from a source of pressured liquid, such as city water, to quick-disconnect hose couple 14 and allowing water to flow therein. A dispensing wand 140 including a dispensing valve 142 is secured to the end of delivery tube 130. When dispensing valve 142 is in its closed condition, water flowing into plastic container 101 pressurizes the container without the need for using hand pump assembly 150. A detailed description of sprayer 100 and dispensing valve 142 and their operation is included in U.S. Pat. No. 4,782,982 entitled SELF-PRESSURIZING CHEMICAL SPRAYER, which is hereby incorporated herein by reference.

Preferably, filling valve 12 and hose coupler 14 are positioned in the top wall 101*a* of container 101. This makes it easier to connect hose 126 via coupling 125 in that one can press downwardly against coupler 14 while container 101 is resting on the ground or other firm surface. If coupler 14 were located in the side of container 101, the user would have to hold container 101 against movement while pressing hose 126 and coupling 125 onto coupler 120.

A conventional hand pump assembly 150 including a threaded closure 151 is threaded over the threaded top opening 104 of container 101. Pump handle 152 includes an elongated groove integrally formed therein so that wand 140 can be seated in the groove for storage and transport. Handle 152 can be released for pumping to facilitate hand pressurization of container 101, or it can be locked in a down position to serve as a carrying handle for sprayer 100. Sprayer 100 can also be carried by the user over his shoulder by means of a carrying strap 160 suitably fastened to container 101.

Hand pump assembly 150 serves not only as a closure for receptacle 101, but also makes it possible to repressurize receptacle 101 when the user is remote from the source of liquid under pressure which is being used. Thus, a homeowner spraying chemicals on his lawn might be at a remote location from the hose and still have some chemical solution remaining in container 101. He can simply use hand pump 150 to repressurize receptacle 101 and finish using the solution therewithin.

To initially pressurize container 101 of sprayer 100, a hose 126 connected to a pressurized source of the liquid to be sprayed is coupled to quick-disconnect coupler 14 by means of its mating quick-disconnect coupler 125. Coupler 125 is preferably of the conventional type which automatically allows the fluid under pressure to pass when it is coupled to coupling 120. If the fluid is water and one desires to spray a solution of chemicals, the chemicals are first introduced into container 101 through top opening 104 by simply unthreading top closure 151 and removing pump/handle assembly 150. With the solid or liquid chemicals introduced into container 101, closure 151 is again threaded onto threaded top opening 104 and hose 126 is coupled as described above.

Typically, container 101 will be filled with water coupled to a house or industrial water system. Usually, the pressure of such water is a fairly predictable 60 to 70 psi. However, to help avoid overstressing the tank by inadvertently pressurizing it from higher pressure systems, filling valve 12 includes means responsive to the difference in pressure between the source of liquid in hose 126 and the interior of container 101 to close the valve when this pressure exceeds a predetermined value. Valve 12 includes a tank adapter 16 which has a quick-disconnect hose coupler 14 at an end extending externally of container 101, and a threaded portion 18 that threadably engages mating threads formed in recess 102 (FIG. 2). Valve 12 further includes an internal portion 20 which extends into the interior of container 101. An annular flange 48 on valve portion 20 is received within recess 102 and is captured therein and restrained against the pressure developed in the tank by the engagement between threaded portion 18 of tank adapter 16 and the threads defined in recess 102. A gasket 50 seals the interface between adapter 16 and tank wall 101*a*.

Tank adapter portion 16 defines a liquid flow passage 22 therethrough having a narrow, outer portion 24 and a wider inner portion 26. The transition from portions 24 to 26 defines a downwardly facing, frustoconically-shaped valve seat 28 which interacts with an upwardly facing, frustoconically-shaped surface 30. Surface 30 is defined on a plunger 32 which is freely reciprocable within passage 22. Inner valve portion 20 is elongated and includes a liquid flow passage 34 which extends along its length and is connected with passage 22. An upwardly facing, frustoconically-shaped valve seat 36 is defined on valve portion 20 surrounding flow passage 34 and interacts with a similarly-shaped surface 38 defined on plunger 32. A pair of elongated openings 40 extend from liquid flow passage 34 to the interior of container 101. A biasing spring 42 is positioned within passage 34 and extends from a bottom surface 44 of inner valve portion 20 to passage 22 where it is capped at its opposite end by a spring cap member 46.

Figure 7:
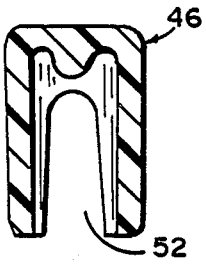
FIG. 7 is a cross-sectional view of the spring cap portion of the filling valve.

Spring cap 46, as illustrated in FIG. 7, includes a pair of elongated openings 52 which provide a fluid flow path between passages 22 and 34 when the valve is in the position illustrated in FIG. 2. When, however, spring 42 is compressed by plunger 32 acting on member 46, openings 52 are positioned entirely within flow passage 34 and no longer provide a flow path between passages 22 and 34 as illustrated in FIG. 2*b*. Plunger 32 includes a plurality of guide members 54 extending radially outwardly from the outer elongated portion 56 positioned within passage 24. The purpose of guide members 54 is to provide smooth reciprocal movement of plunger member 32 without allowing canting of the member, which may cause it to seize. Additionally, guide members define openings therebetween which allows fluid flow around portion 56 of the plunger. A second set of guide members 58 extend outwardly from the enlarged lower portion 31 of plunger 32 and serve to keep portion 31, which includes valve sealing surfaces 30 and 38, in proper alignment with respective valve seats 28 and 36.

In operation, liquid flowing through flow passages 22 and 34 from a pressurized liquid source such as a water faucet will cause a pressure differential to develop across plunger portion 31 which will exert a downward force tending to compress spring 42. If the net pressure across plunger portion 31 is sufficiently high, spring 42 will be compressed until surface 38 engages valve seat 36 which will close the flow passages to additional flow. When, however, the pressure differential across plunger portion 31 is not sufficient to engage surfaces 38 and 36, the valve will assume the position illustrated in FIG. 2 and liquid will flow around portion 31 and through openings 52 and 40 into the interior of container 101. If, however, hose coupling 14 is connected to a source of liquid that is greater than conventional residential or industrial pressure, the additional pressure differential across portion 31 will cause filling valve 12 to close as illustrated in FIG. 2 to prevent container 101 from being filled from this dangerously high pressure source. Although valve 12 is responsive to a pressure differential between the source and the interior of the container, not absolute pressure of the source, it can be assumed that, when the source of liquid is connected to the container, the interior of the container is at atmospheric pressure because the sequence of operation of the device dictates that the container be opened through opening 104 to insert chemicals before pressurizing the container for spraying. Thus, valve 12 would close in response to the excessive source pressure and would not allow the container to become pressurized from that source.

When the container 101 has been partially or completely filled from a suitable source of liquid and hose connector 125 is disconnected from quick-disconnect hose coupler 14, a negative pressure will develop across lower portion 31 of the valve plunger because the pressure within container 101 acting against surface 38 is greater than the pressure acting on surface 30 which is now at atmospheric pressure. The negative pressure across portion 31 will force plunger 32 upwardly until surface 30 engages valve seat 28, as illustrated in FIG. 2*a* which will prevent any flow of liquid out of container 101.

It is to be noted that it is the back-pressure developed within container 101, not the force exerted on plunger 32 by spring 42, that closes the inlet valve when it is disconnected from a source of pressurized liquid. It has been discovered that only a very small positive pressure within container 101 is required to position the valve in the closed position illustrated in FIG. 2*a*. Therefore, it is not required that spring 42 bias surfaces 28 and 30 together. Furthermore, spring 42 requires a substantially large spring force to allow the inlet valve to be open when the container is filled from a normal pressure source (approximately 70 psi) and close when the container is connected to a source of excessive pressure. It has been discovered that this relatively large spring force prevents spring 42 from being adequately sensitive in order to only bias surfaces 28 and 30 together when a slight positive pressure exists within container 101. Therefore, spring 42 is sized so that it will be fully relaxed in the position, illustrated in FIG. 2*a*. Thus, the fluid pressure differential across member 31, not spring 42, closes the inlet valve when the source of pressurizing liquid is removed.

Thus, it is seen that valve 12 provides protection against filling container 101 from a source having too high of a pressure and provides back-flow prevention to close container 101 after it has been pressurized and the filling hose has been disconnected therefrom. In a preferred embodiment, tank adapter 16 and internal portion 20 are made from a polymeric material such as Delrin. Spring 42 is made from stainless steel and spring cap 46 from a polymeric material such as a copolymer. Plunger 32 is made from synthetic rubber having a durometer value of 60.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows.

1. A portable sprayer apparatus for dispensing liquids under pressure comprising:

a closed receptacle for containing liquids under pressure, said receptacle including a dispensing outlet operably connected to dispensing valve means which can be opened to dispense liquid under pressure or closed to seal said container;

a pressure responsive filling valve means extending through wall of said receptacle for admitting liquid to the interior of said receptacle from an external source of liquid, said valve means being responsive to the pressure of said source and the pressure within said receptacle to close when said pressure of said source exceeds a predetermined value and when said pressure within said receptacle exceeds said pressure of said source whereby said valve will close when the source is disconnected from the receptacle after filling thereof and if it is attempted to fill the receptacle from a source having an undesirably high source pressure.

2. The portable sprayer apparatus in claim 1 in which said inlet valve means includes wall means defining an inlet flow passage, a pressure responsive member in said passage, a first valve seat, a second valve seat and surface means responsive to said member for engaging said first valve seat when the pressure across said member exceeds a predetermined value and for engaging said second valve seat when said pressure is substantially negative.

3. The portable sprayer apparatus in claim 2 in which said first valve seat is defined by said wall means and faces generally upstream said liquid flow and said second valve seat is defined by said wall means and faces generally downstream said liquid flow and further wherein said surface means includes a first surface portion aligned with said first valve seat and faces generally downstream said liquid flow and a second surface portion aligned with said second valve seat and faces generally upstream said liquid flow.

4. The portable sprayer apparatus in claim 3 in which said pressure responsive member and said surface means are positioned on a plunger member that is reciprocable in said passage.

5. The portable sprayer apparatus in claim 4 in which said surface means is defined by said pressure responsive member.

6. The portable sprayer apparatus in claim 5 including biasing means for biasing said plunger upstream said flow of liquid, said biasing means comprising a spring in said passage downstream of said plunger.

7. The portable sprayer apparatus in claim 6 in which said spring is preselected to position said surface means between said first and second valve seats when said spring is not loaded such that said surface means engages said second valve seat solely in response to the fluid pressures in said flow passage.

8. The portable sprayer apparatus in claim 2 including biasing means for biasing said surface means away from said first valve seat, said biasing means being insufficient to bias said surface means into engagement with said second valve seat.

9. The portable sprayer apparatus in claim 1 including means defining an opening in said receptacle and a resealable closure for said opening which can be opened to allow the insertion of chemicals into said container and then reclosed and resealed to allow pressurization through the introduction of liquid under pressure.

10. The portable sprayer apparatus in claim 1 including means defining an opening in said receptacle wall and wherein said inlet valve means extends through said wall in said opening.

11. The portable sprayer apparatus in claim 10 in which said valve means includes a first portion extending from said opening into said receptacle interior and a second portion extending from said opening externally of said receptacle, said first portion including means defining a first valve seat and biasing means, said second portion including means defining a second valve seat and a valve plunger, said biasing means biasing said plunger outwardly from the interior of said receptacle and said plunger including means defining a surface having a first surface portion which sealingly engages said first valve seat against the bias of said biasing means when the pressure across said surface exceeds a predetermined value and a second surface portion which sealingly engages said second valve seat when the pressure across said surface is substantially negative.

12. The portable sprayer apparatus in claim 11 in which said opening includes surface means defining a threaded recess in said receptacle wall having a flat surface portion in said recess surrounding said opening, said first valve means portion having a flange engaging said flat surface portion and said second valve means portion having means defining threads engagable with said threaded recess and said flange to retain both said valve means portions in said opening against the internal pressure of said receptacle.

13. The portable sprayer apparatus in claim 12 in which said first valve means portion includes an elongated member having means defining a bore therethrough opening into the interior of said receptacle, said biasing means being positioned in said bore.

14. The portable sprayer apparatus in claim 13 in which said biasing means comprises a spring and further including a cap extending over an end of said spring which engages said plunger.

15. The portable sprayer apparatus in claim 14 in which said cap is positioned in said bore adjacent said first valve seat and includes wall means and means defining an opening through said wall means such that liquid can flow through said opening in said wall means when said plunger is biased away from said first valve seat.

16. The portable sprayer apparatus in claim 12 in which said second valve means portion includes a portion defining a quick-disconnect fitting.

17. The portable sprayer apparatus in claim 11 in which said first valve means portion includes an elongated member having means defining a bore therethrough opening into the interior of said receptacle, said biasing means being positioned substantially in said bore.

18. The portable sprayer apparatus in claim 17 in which said biasing means comprises a spring and further including a cap extending over an end of said spring which engages said plunger.

19. The portable sprayer apparatus in claim 18 in which said spring has a length that is preselected to position said plunger surface spaced from both of said valve seats when said spring is not loaded, such that said second surface portion sealingly engages said second valve seat solely in response to the fluid pressure across said surface.

20. The portable sprayer apparatus in claim 18 in which said cap is positioned in said bore adjacent said first valve seat and includes wall means and means defining an opening through said wall means such that liquid can flow through said opening in said wall means when said plunger is biased away from said first valve seat.

21. The portable sprayer apparatus in claim 10 in which said second valve means portion includes a portion defining a quick-disconnect fitting.

22. The portable sprayer apparatus in claim 11 in which said valve means includes wall means defining a liquid flow passage therethrough and in which said plunger includes an elongated portion extending from said plunger surface and positioned in said liquid flow passage, said elongated portion having an elongated central portion and a plurality of guide members extending from said central portion to prevent canting of said plunger while accommodating flow of liquid along said flow passage.

23. The portable sprayer apparatus in claim 11 in which said valve seats and said plunger surface portions are each frustoconically-shaped and in which said plunger includes a plurality of guide members extending from said plunger surface to keep said plunger surface portions aligned with said valve seats.

* * * * *